United States Patent [19]

Michaels et al.

[11] 4,255,007

[45] Mar. 10, 1981

[54] MULTI-TERMINAL ROTARY CONNECTOR

[75] Inventors: Leonard H. Michaels, Warrenville; Garry W. Thompson, Bensenville; Richard Zic, Chicago, all of Ill.

[73] Assignee: TRW Inc., Elk Grove Village, Ill.

[21] Appl. No.: 905,274

[22] Filed: May 12, 1978

[51] Int. Cl.[3] ..... H01R 13/62; H01R 25/12

[52] U.S. Cl. ..... 339/88 R; 339/49 R; 339/101

[58] Field of Search ..... 339/88 R, 107, 187, 339/189 R, 188 R, 188 C, 190, 90 R, 90 C, 61 R, 61 M, 64 R, 64 M, 49 B, 16 RC, 47, 339–475, 144 R, 101

[56] References Cited

U.S. PATENT DOCUMENTS

| | | | |
|---|---|---|---|
| 2,102,625 | 12/1937 | Hubbell | 339/190 X |
| 2,749,527 | 6/1956 | Gast | 339/144 R X |
| 2,751,569 | 6/1956 | Anderson et al. | 339/188 R |
| 3,121,599 | 2/1964 | Modrey | 339/189 R X |
| 3,154,646 | 10/1964 | Jurca et al. | 339/188 C X |
| 3,233,203 | 2/1966 | Kennedy et al. | 339/188 C X |
| 3,525,068 | 8/1970 | Nelson | 339/88 R X |
| 3,986,765 | 10/1976 | Shaffer et al. | 339/187 X |
| 3,989,337 | 11/1976 | Stelling | 339/90 R |

FOREIGN PATENT DOCUMENTS

| | | | |
|---|---|---|---|
| 2260203 | 8/1975 | France | 339/90 R |

*Primary Examiner*—Eugene F. Desmond

*Attorney, Agent, or Firm*—Neuman, Williams, Anderson & Olson

[57] ABSTRACT

A multi-terminal rotary connector assembly including a plug having a generally circular mating end with contacts thereabout. A receptacle has a generally circular opening with contacts therein for receiving and mating with said plug to engage the contacts thereof. The receptacle includes an axially mounted and extending polarization and anti-separation stud for insertion into a corresponding axial aperture in the mating end of the plug. The contacts of the plug and receptacle are spaced from one another circumferentially as the plug and receptacle are mated axially, and engage one another only when the polarizing stud has been received into the axial aperture in the plug and the plug has been rotated with respect to the receptacle to its locked position. During rotation the apexes of the plug contacts slide past the apexes of the receptacle contacts to inhibit counter-rotation. Both the plug and the receptacle may include retention and strain relief means for attachment to an electrical cable.

15 Claims, 7 Drawing Figures

17
3
16
21
2
15
26
25
20
10B
30
31
32
10A
12
11
1
14
13
52
51
4
44
10
43
41
42

MULTI-TERMINAL ROTARY CONNECTOR

BACKGROUND OF THE INVENTION

This invention relates generally to a multi-terminal connector for joining two electrical cables or joining a cable to a mounted fixture such as a panel receptacle.

In such a connector it is desirable that connection and disconnection be made easily and quickly and that the connections, when made, be highly reliable. It is also desirable and often imperative that there be no inadvertent touching of the contacts except as desired in order to eliminate damage to connected circuits. In this regard, it is desirable that means be employed to keep the contacts separated to avoid inadvertent touching until the connector parts are properly aligned and in position to establish electrical contact. Once aligned, connection should be made easily and securely as the contacts are engaged. While the contacts are engaged, they should be free from external forces which would otherwise disturb their electrical continuity.

SUMMARY OF THE INVENTION

The invention is embodied in a multi-terminal biparte rotary connector assembly including a plug and receptacle. The plug is made of insulating material having a generally circular first end with an axial aperture in the first end for receiving an anti-separation and polarization stud in a singular orientation. A plurality of rounded electrical contacts are exposed on the first end of the plug. The receptacle also is of insulating material and has a generally circular opening to mate with the first end of the plug and has an anti-separation and polarization stud disposed axially of this opening. The stud is inserted into and, when fully inserted, is rotated with respect to the plug aperture to releaseably lock the plug and receptacle in a singularly oriented and mated position. A plurality of rounded electrical contacts are exposed inside the opening of the receptacle and positioned so that the plug contacts engage the receptacle contacts only when the polarization stud is received into the axial aperture and the plug is rotated with respect to the receptacle to its locked position. As the plug is rotated, the apexes of the plug contacts slide past the apexes of the receptacle contacts to inhibit counter-rotation.

Strain relief may be provided for the electrical cables where they attach to the connector assembly.

OBJECTS OF THE INVENTION

It is an object of the present invention to provide an improved multi-terminal connector assembly for joining two multi-conductor electrical cables.

It is a further object of the present invention to provide an electrical connector which may be coupled only in the desired position and insure isolation of the plug contacts from the receptacle contacts unless the connector parts are correctly mated.

It is a further object of the present invention to provide an electrical connector whose plug and receptacle portions mate easily with a minimum of force.

It is a further object of this invention to provide an improved circular connector affording so-called zero insertion force, i.e. without wiping contact between the contacts during insertion or withdrawal.

It is still a further object of the present invention to provide an improved anti-separation and polarization device to insure that the plug and receptacle may be joined in only the desired orientation, and once joined, remain so until unlocked.

It is still a further object of the present invention to provide an improved set of contacts which provide reliable electrical continuity and help maintain the plug and receptacle in their mated position.

These and other objects will become readily apparent from this present specification, drawings, and appended claims.

DESCRIPTION OF THE PREFERRED EMBODIMENT

Figures 1, 2, 4:
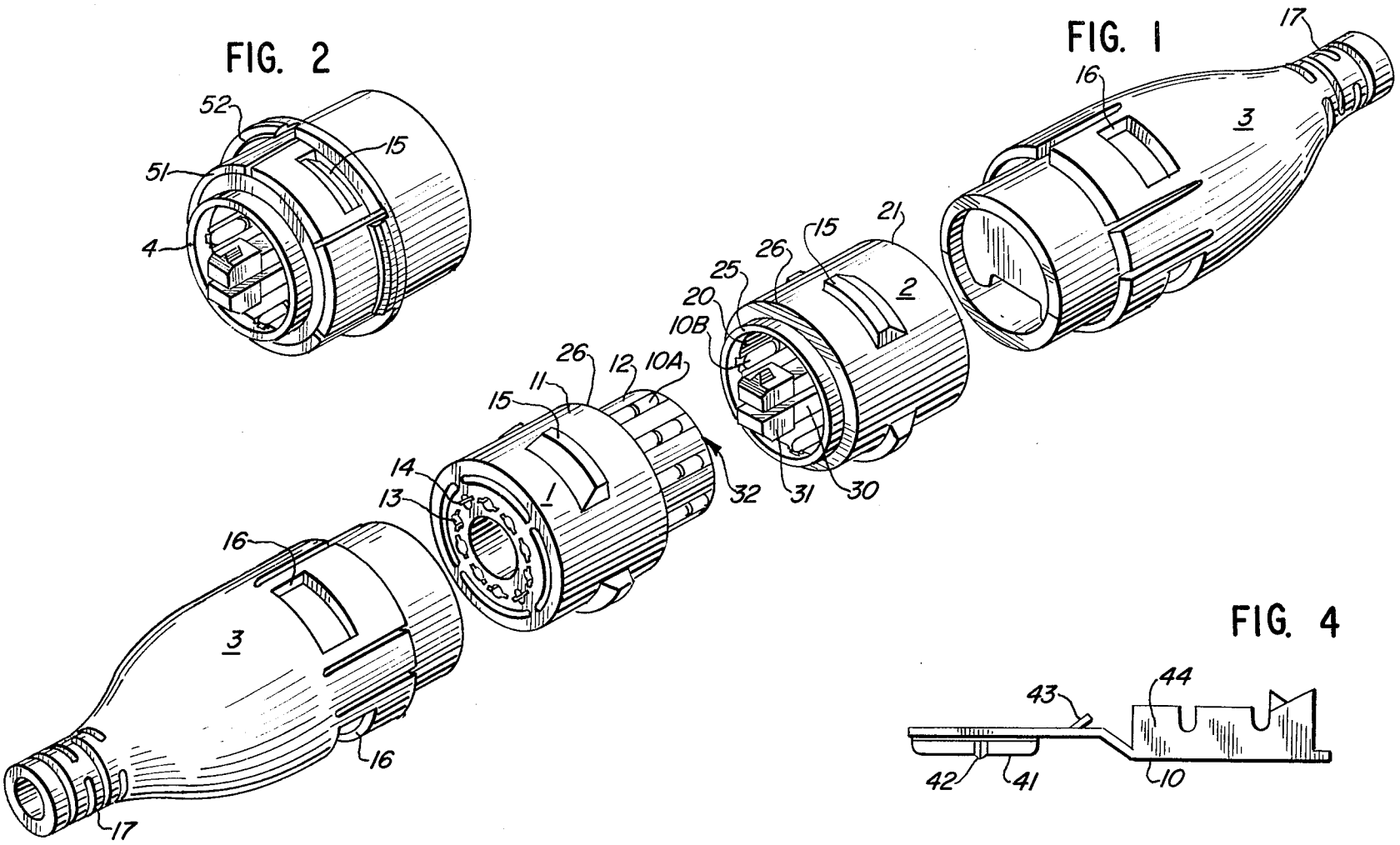
FIG. 1 is an exploded view of a rotary connector employing teachings of this invention.
FIG. 2 is a perspective view of a receptacle as in FIG. 1 adapted for mounting in a panel.
FIG. 4 is a side view of a contact used in the plug and receptacle of FIGS. 1, 2, 3, 4, 5A and 5B.

As seen in FIG. 1 of the drawings, a connector plug 1 and a connector receptacle 2 are shown in line with strain relief means 3 for both the plug 1 and receptacle 2. The strain relief may be utilized to grip the respective wires or cables to minimize strain on the contacts when the connector joins two electrical cables.

Figure 3:
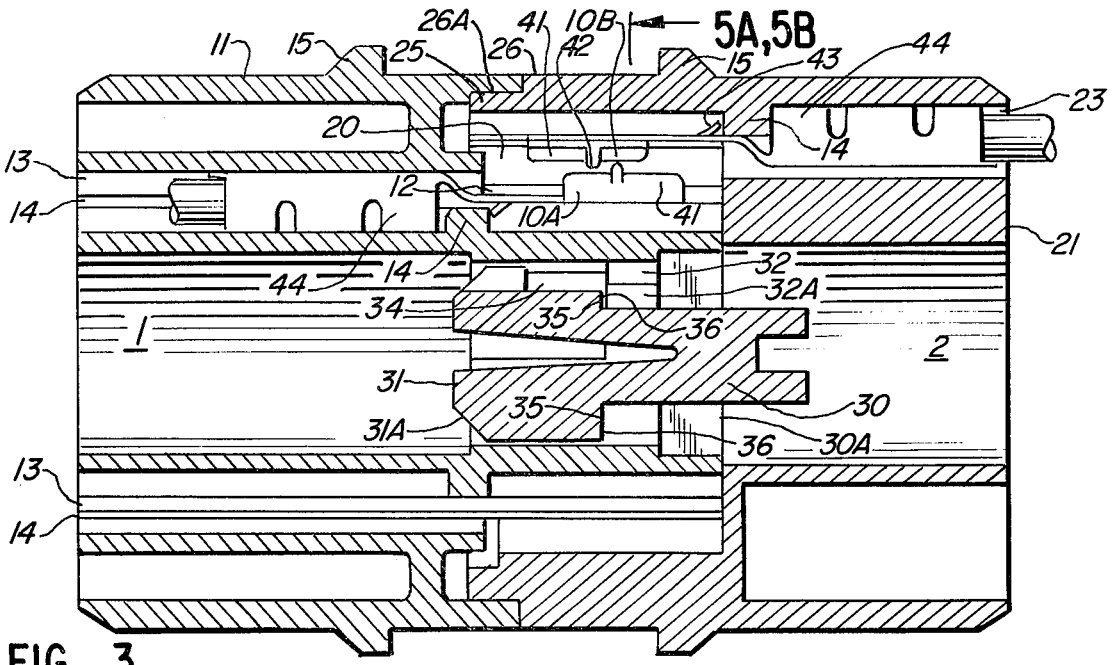
FIG. 3 is a longitudinal cross section of the connector of FIG. 1 showing a plug inserted into a receptacle in the locked position.

Referring also to FIG. 3 the plug 1 comprises a body which preferably is a unitary molding of insulating material, and a plurality of contacts 10A. A main body portion 11 is larger than a generally circular mating end 12. The main body 11 may be of any convenient shape. Extending through the main body 11 parallel to the axis thereof is a plurality of contact chambers 13 which continue to the mating end 12 to receive the contacts 10A. The chambers 13 are radially spaced from the main axis of said plug and allow sufficient insulating material between the contacts 10A, as at **13*a* of FIG. 5A, to insure electrical isolation of one contact from another. A contact guiding and stop shoulder 14 extends into each chamber 13 near its inner end. The number of chambers 13 may be varied in accordance with the number of contacts desired in a particular embodiment of the connector. The configuration of each chamber 13 and the respective shoulder 14 may be altered as desired to facilitate use and assembly of various contacts. Each contact 10A typically is attached to one end of a wire of a first cable (not shown) by a portion 44 prior to mounting in the connector body. Portion 44 is then disposed in the respective contact chamber 13 and extends therethrough to a portion 41 which is exposed on the mating end 12 of the plug 1**. The chambers, and thus the contacts, typically are disposed at regular intervals along a common circle concentric with the plug.

Figure 6:
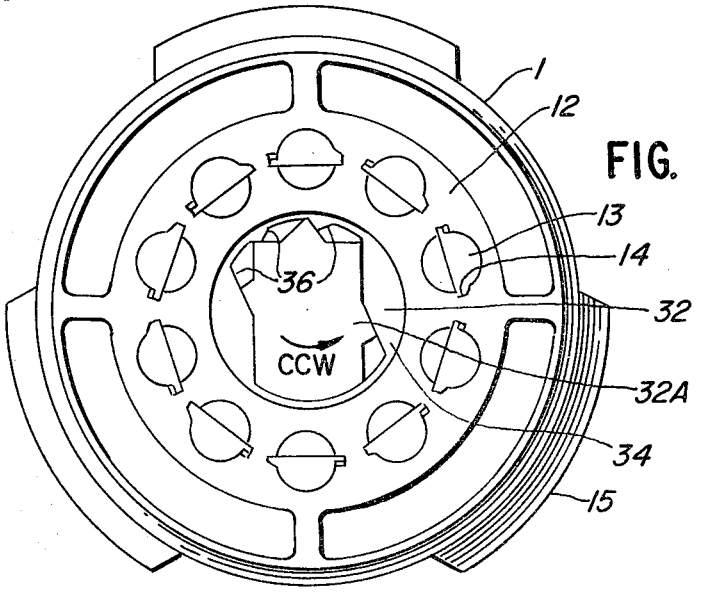
FIG. 6 is an end view of a plug looking towards the cable end.

Referring now to FIGS. 3 and 6, the plug body also includes a central web 32 defining an axial aperture 32A of irregular shape, within the mating end 12. Inwardly of the aperture 32A and on the same axis, the plug defines a recess 34 which is larger in average diameter than the irregular shape of aperture 32A.

Referring again to FIGS. 1 and 3, the connector receptacle 2 includes a body molded of insulating material and having an enclosing end 26 defining a generally circular opening 20. Said opening 20 has a larger diameter than the mating end 12 of plug 1 in order to mate with and enclose said mating end 12. The radial clearance between the mating end 12 and opening 20 may be varied in accordance with the particular contact design, provided the connector may be readily assembled and separated, and reliable electrical contact is maintained.

Disposed about the periphery of the opening 20 are receptacle contacts 10B for attachment to one end of the wires of a second cable (not shown) in the same manner as contacts 10A. Referring also to FIG. 3, and as with the plug 1, extending through the cable end 21 of the receptacle 2 are contact chambers 23 with contact guide shoulders 14. However, the chambers 23 are generally aligned with the inner surface defining opening 20, whereas the chambers 13 are generally aligned with the outer surface of end portion 12. The number of contact chambers 23 and contacts 10B in the receptacle 2 is usually equal to the number of chambers 13 and contacts 10A in the plug 1. In order to simplify maintenance and reduce costs, contacts of the same design and size may be used in the plug in the receptacle.

Both the plug 1 and the receptacle 2 include projections 15 for extending into corresponding openings 16 in the strain relief means 3 for detachable interconnection therewith. A cable clamping sleeve, e.g. of a tortuous path clamp design or a radially collaring gripper type (not shown), is provided in each shell 3, and a slotted tail 17 is provided for strain relief and cable retention to prevent undue strain on the contacts 10A and 10B from forces applied to an attached cable or wire.

An annular flange 25 at the distal end 26 of the receptacle 2 fits into a corresponding annular groove 26A in plug 1, or vice versa as desired. The groove 26A is located at the base of end portion 12, where the smaller diameter mating end 12 joins the larger diameter main body 11. This interface may be of a design, with or without a sealing gasket or ring, to exclude contaminants, such as gases, liquids, and foreign particles.

Referring to FIGS. 1 and 3, an anti-separation and polarizing stud 30 is axially disposed in the receptacle opening 20. The stud 30 protrudes from a central web 30A of the receptacle body with which it is integral. An enlarged irregularly shaped head 31 corresponds to the shape of the axial aperture 32A in the mating end 12 of the plug 1. The head 31 and aperture 32A are shaped so that insertion is possible only when the two shapes are aligned in one desired orientation, thereby insuring correct polarity between the plug 1 and receptacle 2. The head 31 may also be radially compressible and larger, in its rest state, than the aperture 32A, e.g. of a bifurcated design as illustrated. The head 31 includes leading cam surfaces 31A and is compressed, once aligned with the aperture 32A, as it is squeezed through the aperture 32A, and expands in recess 34 once inserted. Shoulder 35 on head 31 bears against shoulder 36 formed by web 32 between aperture 32A and recess 34 upon expansion, and further upon relative rotation of the two connectors. This engagement precludes removal of the stud 30 and head 31 and hence precludes separation of the connectors except upon realignment of the stud head 31 with aperture 32A and compression of the bifurcated head. The resilience of the material provides the spring action of the head 31.

Figure 5A:
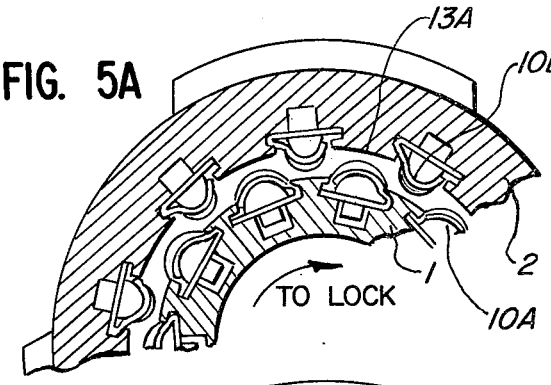
FIG. 5A is a cross-sectional view of FIG. 3 showing a plug inserted into a receptacle in the unlocked position with no contact engagement.

Referring to FIG. 5A, the axial orientation of the head 31 and the receptacle contacts 10B is such that when the head 31 is congruently aligned with the plug aperture 32A, the receptacle contacts 10B are positioned between but not engaging the plug contacts 10A.

The head 31 may be removed from recess 34 by rotating the plug 1 to align the shape of the head 31 with that of the aperture 32 and deliberately applying sufficient longitudinal force to compress the head 31 and remove it from recess 34. So long as the plug 1 and receptacle 2 are separated and the head 31 is not aligned with the aperture 32, abutment of the head 31 against the web 32 or the mating end of the plug 1, without fitting into the aperture 32A, prevents inadvertent touching of the plug contacts 10A and the receptacle contacts 10B, and thereby prevents damage to the connected electrical circuits.

Referring now to FIG. 6, the configuration of aperture 32A in the plug 1, as defined by web 32, corresponds to the shape of the head 31 on stud 30. Once the head 31 is fully inserted, it may be rotated counterclockwise as shown until the lateral surfaces of the head 31 abut against the ridges 36 formed by web 32.

Referring to FIGS. 3 and 4, identical contacts 10 may be used in the plug 1 and receptacle 2. The exposed contacting portion 41 has an elongated domed or rounded shape in this example, but may take on any convenient shape such as a button or blade. The exposed surface 41 of the plug contacts 10A may interfere with the exposed surface portion 41 of the receptacle contacts 10B after the plug 1 has been inserted into the receptacle 2 and the plug is rotated. A circumferential ridge or rib 42 on each contact results in a substantial pressure increase at the point where the ridge 42 bears against the mating contact surface 41 and thereby maintains very low electrical contact resistance. A tab 43 extends from the contact body and interferes with the respective guide rib or shoulder 14 in the contact chamber 23 to lock the contact in place. The terminal portion 44 of the contact 10 is crimped around an electrical conductor, such as a wire from a cable. The crimping attachment may be accomplished prior to insertion of each contact into its chamber 23.

Referring to FIG. 1, the panel mount receptacle 4 is identical to the connector receptacle 2 so that it may accept the same connector plug 1. However, it may be attached to a panel or other relatively smooth surface by attaching a panel mount collar 51 over projections 15. Resilient stop wings 52 protrude from said collar 51 for resiliently bearing against a panel opening. These wings 52 may include a locking lip or groove or be tapered to prevent inadvertent removal of the collar, as is well known in the art.

DESCRIPTION OF THE OPERATION OF THE PREFERRED EMBODIMENT

A multi-conductor cable is inserted through slotted tail 17 of the strain relief means 3. One contact 10 is connected to each conductor in said cable and said contacts are inserted into contact chambers 13 of the appropriate receptacle or plug. Said contacts 10 are held in place as tabs 43 snap over and thereafter bear against guide ribs 14 in contact chambers 13 while the contact shoulder 44 bears against the opposite sides of he ribs 14. This precludes further inward movement or etraction of the contacts.

Figure 5B:
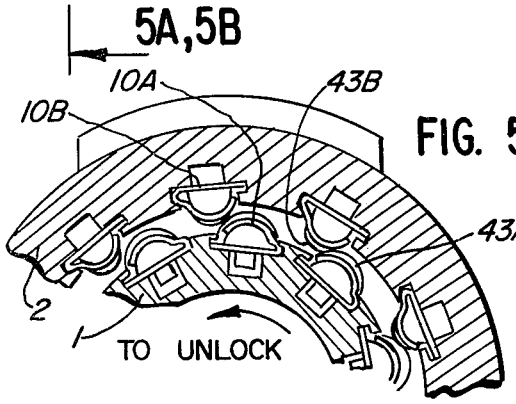
FIG. 5B is a cross-sectional view of FIG. 3 showing a plug inserted into a receptacle in the locked position with the contacts engaged.

Referring now to FIGS. 1 and 3, and utilizing either ı connector receptacle 2 or a panel mount receptacle 4, he connector plug 1 is pressed against the connector eceptacle 2. The head 31 of the anti-separation and olarization stud 30 contacts the mating end 12 of plug l and prevents the connector contacts 10A from engag-ng the receptacle contacts 10B. As the connector plug l is rotated with respect to receptacle 2, the irregularly haped connector aperture 32A aligns with the corre-spondingly shaped head 31 of the polarization stud 30. Once aligned, the mating end 12 of plug 1 is inserted nto the opening 20 of receptacle 2 concurrently as the olarization stud is inserted into aperture 32A as the lug is being inserted into the receptacle. The plug contacts 10A thereby are spaced between the receptacle contacts 10B. As the plug 1 is inserted into the receptacle 2, the aperture 32A radially compresses the polarization head 31 until the plug 1 is completely seated into he opening 20. Once seated, the head 31 expands to its usual diameter in recess 34 inhibiting the separation of he plug 1 and receptacle 2. This provides an audible, positive snap action lock to insure proper insertion of he plug 1. Once the head 31 is clear of aperture 32, plug 1 may be rotated with respect to receptacle 2 to engage the contacts. As rotation occurs, the exposed portion 41 of the contacts 10A and 10B engage each other at their respective circumferential ridges 42 and rotation continues until the apexes 43A of the plug contacts 10A slide just past the apexes 43B of the receptacle contacts 10B to inhibit counter-rotation (see FIG. 5B). The plug 1 is removed from receptacle 2 by reversing the above procedure and applying sufficient unlocking torque in the direction indicated in FIG. 5B to overcome the contact pressure.

The invention has been described in detail with particular reference to a preferred embodiment and the operation thereof, but it is understood that variations, modifications, and the substitution of equivalent mechanisms can be effected within the spirit and scope of this invention, particularly in light of the foregoing teachings.

What is claimed is:

1. A multi-terminal biparte rotary connector assembly including a first plug member having a generally circular first mating end with a generally cylindrical outer periphery;

a plurality of electrical contacts on said first end, each of said contacts having an apex portion exposed radially outward of said periphery;

a second receptacle member having a generally circular opening with a cylindrical inner periphery in a mating end to mate with said first end of said plug member;

one of said members including means defining at least one aperture in the mating end thereof for receiving anti-separation and polarization attachment means in a singular orientation;

anti-separation and polarizing attachment means extending from the mating end of the other of said members for insertion into said aperture means of said one of said members and rotation with respect to said aperture means to releasably lock said plug member and receptacle member in singular oriented mated contact with one another; and a plurality of electrical contacts on the inner periphery of said opening in said receptacle member, each of said latter contacts having an apex portion exposed radially inward of said inner periphery and disposed such that the plug contacts engage the receptacle contacts only when said attachment means is received into said aperture means and said members are rotated with respect to one another to said locked position, the apex portions of each of said engaging contacts including a generally rounded contacting surface and a raised contact portion extending above the respective rounded surface thereof, said raised contact portion of abutting pairs of said contacts spaced from one another to contact said rounded contacting surface of an opposed contact of the other member when said members are in said locked position, said contacts interfering with and sliding past one another as said members are rotated to said locked position to thereafter inhibit counter-rotation.

2. A connector assembly as in claim 1 wherein said attachment means comprises a stud element aligned axially of one of said members and said aperture means defines a corresponding aperture disposed axially of the other of said members.

3. A connector assembly as in claim 2 wherein said stud member includes a distal end which is larger than said aperture, and said stud being laterally collapsible for passage through said aperture.

4. A connector assembly as in claim 3 wherein said distal end of said stud member extends from one of said members so that said first member contacts engage said second member contacts only when said distal end has been inserted into said aperture means of said one of said members and rotated with respect to said aperture means.

5. A connector assembly as in claim 1 wherein each of said members comprises a unitary molded body of insulation material formed with cavities extending therethrough from the respective mating end and said contacts are disposed in part within said cavities.

6. A connector as in claim 1 wherein each of said electrical contacts comprises a protruding tab mediate said end portions thereof.

7. A connector as in claim 1 wherein said plug member further comprises:

a second end larger than said first end and formed with contact chambers extending therethrough to said first end, means to position and retain said plug contacts in said contact chambers; and means on said plug for detachably connecting electrical conductor retention and strain relief means.

8. A connector as in claim 7 wherein said means for positioning and retaining each contact comprises a shoulder of said plug member protruding within the respective chamber.

9. A connector as in claim 1 wherein said receptacle further comprises:

a second end with contact chambers generally parallel to the axis of said receptacle and extending therethrough to said first end, means to position and retain said receptacle contacts in said chambers; and means on said receptacle for detachably connecting electrical conductor retention and strain relief means.

10. A connector as in claim 9 wherein said means for positioning and retaining each contact comprises a shoulder of said receptacle member protruding within the respective chamber.

11. A connector as claimed in claim 1 wherein said receptacle further comprises means attached to said receptacle for attaching said receptacle to a panel.

12. A connector as in claim 1 further including at least one smoothly tapered generally conical exterior strain relief shell detachably connectable to the non-mating ends of both said plug member and said receptacle member, said shell including means to retain a cable passing therethrough.

13. A connector as in claim 1 wherein the apex portion of each of said contacts is elongated and disposed generally parallel to the axis of said connector assembly.

14. A connector as in claim 1 wherein said raised contact portion is a narrow circumferential rib extending transversely of said contact.

15. A connector as in claim 1 wherein said raised contact portion is a narrow circumferential rib extending transversely of the width of said contact and extending from one edge of said rounded portion to the other edge.

* * * * *

UNITED STATES PATENT AND TRADEMARK OFFICE

CERTIFICATE OF CORRECTION

PATENT NO. : 4,255,007

DATED : March 10, 1981

INVENTOR(S) : Leonard H. Michaels et al.

It is certified that error appears in the above—identified patent and that said Letters Patent is hereby corrected as shown below:

Column 4, line 40, "electrical contact" should read -- contact electrical --.

Column 5 should be cancelled and the attached sheet substitute therefor.

Signed and Sealed this

*Eighth* Day of *September 1981*

[SEAL]

*Attest:*

GERALD J. MOSSINGHOFF

*Attesting Officer*

*Commissioner of Patents and Trademarks* the ribs 14. This precludes further inward movement or retraction of the contacts.

Referring now to FIGS. 1 and 3, and utilizing either a connector receptacle 2 or a panel mount receptacle 4, the connector plug 1 is pressed against the connector receptacle 2. The head 31 of the anti-separation and polarization stud 30 contacts the mating end 12 of plug 1 and prevents the connector contacts 10A from engaging the receptacle contacts 10B. As the connector plug 1 is rotated with respect to receptacle 2, the irregularly shaped connector aperture 32A aligns with the correspondingly shaped head 31 of the polarization stud 30. Once aligned, the mating end 12 of plug 1 is inserted into the opening 20 of receptacle 2 concurrently as the polarization stud is inserted into aperture 32A as the plug is being inserted into the receptacle. The plug contacts 10A thereby are spaced between the receptacle contacts 10B. As the plug 1 is inserted into the receptacle 2, the aperture 32A radially compresses the polarization head 31 until the plug 1 is completely seated into the opening 20. Once seated, the head 31 expands to its usual diameter in recess 34 inhibiting the separation of the plug 1 and receptacle 2. This provides an audible, positive snap action lock to insure proper insertion of the plug 1. Once the head 31 is clear of aperture 32, plug 1 may be rotated with respect to receptacle 2 to engage the contacts. As rotation occurs, the exposed portion 41 of the contacts 10A and 10B engage each other at their respective circumferential ridges 42 and rotation continues until the apexes 43A of the plug contacts 10A slide just past the apexes 43B of the receptacle contacts 10B to inhibit counter-rotation (see FIG. 5B). The plug 1 is removed from receptacle 2 by reversing the above procedure and applying sufficient unlocking torque in the direction indicated in FIG. 5B to overcome the contact pressure.

The invention has been described in detail with particular reference to a preferred embodiment and the operation thereof, but it is understood that variations, modifications, and the substitution of equivalent mechanisms can be effected within the spirit and scope of this invention, particularly in light of the foregoing teachings.

What is claimed is:

1. A multi-terminal biparte rotary connector assembly including a first plug member having a generally circular first mating end with a generally cylindrical outer periphery;

a plurality of electrical contacts on said first end, each of said contacts having an apex portion exposed radially outward of said periphery;

a second receptacle member having a generally circular opening with a cylindrical inner periphery in a mating end to mate with said first end of said plug member;

one of said members including means defining at least one aperture in the mating end thereof for receiving anti-separation and polarization attachment means in a singular orientation;

anti-separation and polarizing attachment means extending from the mating end of the other of said members for insertion into said aperture means of said one of said members and rotation with respect to said aperture means to releasably lock said plug member and receptacle member in singular oriented mated contact with one another; and